US005472270A

United States Patent [19]

Czarnecky et al.

[11] Patent Number: 5,472,270

[45] Date of Patent: Dec. 5, 1995

[54] CONVERTIBLE CABINET

[75] Inventors: Joseph A. Czarnecky; Christopher J. Neff, both of Troy; Scott L. Strait, Greenville, all of Ohio

[73] Assignee: Midmark Corporation, Versailles, Ohio

[21] Appl. No.: 270,671

[22] Filed: Jul. 5, 1994

[51] Int. Cl.[6] ..... A47B 47/00

[52] U.S. Cl. ..... 312/265.6; 312/330.1; 312/257.1

[58] Field of Search ..... 312/334.4, 400, 312/410, 330.1, 334.7, 334.4, 334.22, 348.1, 265.6, 265.4, 263, 265

[56] References Cited

U.S. PATENT DOCUMENTS

| | | | |
|---|---|---|---|
| 3,716,282 | 2/1973 | Propst et al. . | |
| 3,716,284 | 2/1973 | Vogt . | |
| 3,856,374 | 12/1974 | Christen | 312/263 |
| 4,681,381 | 7/1987 | Sevey . | |
| 4,861,123 | 8/1989 | Russell . | |
| 5,031,974 | 7/1991 | Feucht et al. | 312/263 |
| 5,069,511 | 12/1991 | Swets et al. . | |
| 5,235,795 | 8/1993 | DeBusk . | |
| 5,378,057 | 1/1995 | Bauch et al. | 312/334.4 |

OTHER PUBLICATIONS

MILCARE CARTS catalog, undated.

DATEL—BYRUM catalog, for Medical Storage, Distribution & Workstation Systems for Hospitals, Labs, Clinics and Pharmacies, ©1993.

WATERLOO Storage & Delivery Systems catalog, "The Storage & Delivery Systems Solution" for Carts, Accessories and Supplemental Storage Components for Health Care ©1986.

WATERLOO Storage & Delivery Systems, "1–800–CARTS–2–U", catalog undated.

*Primary Examiner*—Kenneth J. Dorner
*Assistant Examiner*—Gerald A. Anderson
*Attorney, Agent, or Firm*—Biebel & French

[57] ABSTRACT

A drawer-type storage cabinet, particularly adapted for use in the health care industry is convertible from a cabinet which employs mechanical extension glides removably mounted on inner side walls, for supporting individual drawers, to a glide-type support in which a pair of molded plastic side wall liners are located on the inner side walls, after the removal of the removable mechanical extension glides. The side wall liners are formed with a plurality of shelf-supporting ledges for receiving thereon slide-type storage devices including wire shelves, molded plastic tubs and the like. The change over is accomplished without removing the cabinet from its installed condition.

3 Claims, 9 Drawing Sheets

CONVERTIBLE CABINET

BACKGROUND OF THE INVENTION

Storage cabinets and containers as used in the health care industry include built-in cabinets, stand-up shelving, carts, desks, lockers, dispensing trays, and a wide variety of specialty units serving the particular needs of examining rooms, waiting rooms, special procedure rooms, pharmacies, operating and recovery rooms, storage rooms, and intermediate locations. This aggregate of storage and hospital or health care material handling equipment has become known by the term "casework." A health care facility, such as a hospital, will often employ a wide variety of casework, much of which has been configured or designed so that it serves the special needs of the health care provider or the patient at a particular site. Therefor such casework often is not compatible or interchangeable with casework at a different site, and it often cannot easily be reconfigured to a different use at the some site. A health care facility may thus have a substantial investment in less than full functional casework.

The logistics of handling and moving medical supplies may be appreciated by understanding that thousands of sterile and non-sterile medical supplies are required, and are either held or retained in storage, or are ordered from medical suppliers on an "as-needed" basis. These include such items as surgical sponges, drapes, basins, needles, instruments, and medications, much of which is intended for a single use.

The problems of storage and maintenance of inventory have lead to the practice of collecting into groups many, if not all, of the disposable medical items anticipated for particular procedures, which items may be grouped, prepackaged, and delivered in a just-in-time fashion from a medical supplier. Such items and products may be collected in a "procedure tray" which must be moved as necessary to follow the procedure or the patient. These requirements of mobility and interchangeability of function distinguish health care casework from conventional office cabinets, desks, storage and document filing facilities.

As procedures evolve, and as the utilization of health care spaces change, casework and cabinetry which had been configured for a particular purpose may no longer suit the needs of its present location. Such cabinetry can impede, rather than aid, in the mobility of supplies, and may fail to provide proper storage or protection for such supplies.

In view of the high cost of initial acquisition and installation, there is a need to provide a casework arrangement and system by which the internal storage modes of certain casework may be changed and/or converted at a minimum expense and trouble.

While commonality and interchangeability of storage modes has been proposed, and to some extent has been utilized, a particularly difficult and unresolved problem resides in the full utilization of drawer-type bases and cabinets which have been configured to have particular drawer sizes and uses. Commonly such cabinets have permanent drawer gliding or drawer supporting structures which impede or prevent the conversion of such a cabinet to another use.

A particular need exists for a cabinet system which provides for internal conversion from a pull drawer mode to a slide-type or bin storage mode, such as for supporting and retaining tubs, wire shelving, baskets and the like. Such slide-type containers are commonly stored in tambour-door or vertical type storage cabinets which have multiple access or slotted side walls. These bins, baskets and shelving cannot be fitted into existing drawer-type casework.

The lack of compatibility or flexibility can render useless the drawer-type cabinets, at a high economic loss to the facility. A need therefore exists for drawer-type storage cabinets which may be fully converted to sliding shelf or tub-type storage easily and at minimum expense, and back again to drawer type, whenever the need for such conversion arises.

SUMMARY OF THE INVENTION

The invention is directed to a storage cabinet system in which a pull drawer-type of cabinet, employing mechanical extension glides, is convertible to a slide-type storage system for supporting shelves, bins, baskets and tubs.

In the preferred embodiment of the invention, the casework is formed with inner walls which support drawers mounted on mechanical extension glides. The drawers are in the form of molded pans which may, themselves, readily be removed from the glides, and the glides may then be readily removed from the cabinet inner side walls. The cabinet case is configured to accept a pair of molded inserts which form or define a plurality of vertically spaced slide tracks. These tracks are specifically configured to accept baskets, tubs and shelving, and which, in turn, may support or contain medical supplies, such as procedure trays.

Since the cabinet of this invention may be converted either way between roll-out drawers carried on mechanical extension glides and fixed sides which have non-moving support surfaces for tubs and the like, the investment and value in the casework is enhanced. The total conversion from one system to the other may be accomplished with a minimum of disruption, while leaving the cabinet outer shell or case in its installed position.

It is accordingly an important object of this invention to provide casework, particularly or especially configured for use in the health care industry, which is convertible, in place, from a glide mounted drawer configuration, to a configuration for accepting slide-in storage components, and back again, as needed.

A still further object of the invention is the provision of a novel system in a storage cabinet for supporting slide-in components, such as wire shelves, baskets and trays.

Another object of the invention is to provide a casework system of cabinets which may be converted as installed and in place, between two different kind of storage systems to accommodate changing requirements of a work space, such as a health care facility.

These and other objects and advantages of the invention will be apparent from the following description, the accompanying drawings, and the appended claims.

BRIEF DESCRIPTION OF ACCOMPANYING DRAWINGS

Figure 2:
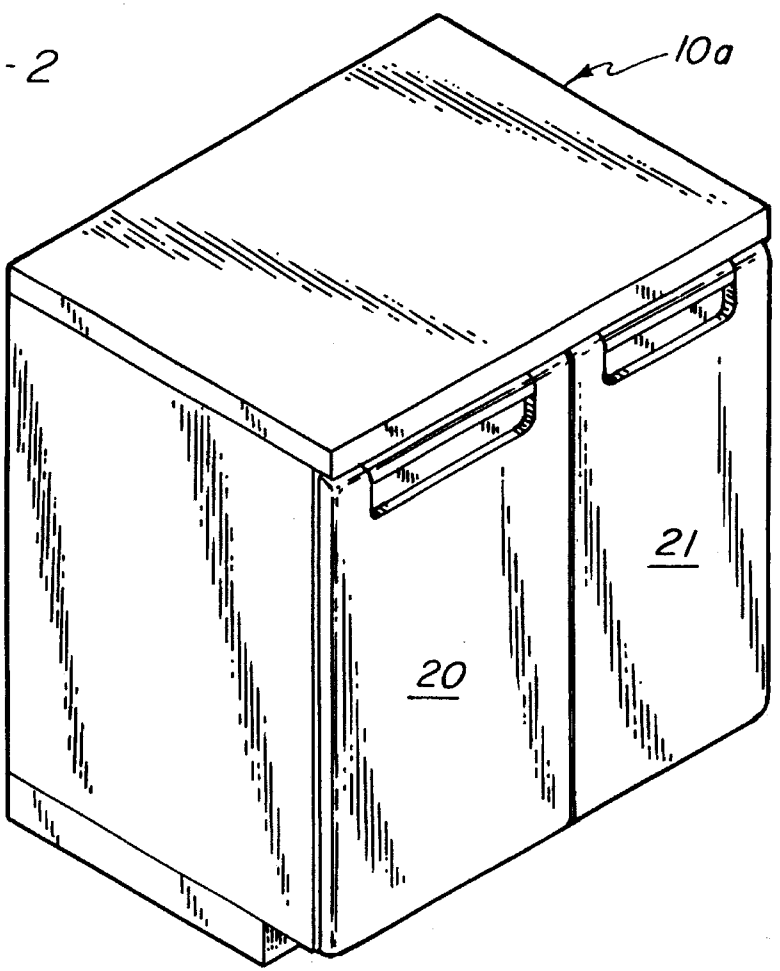
FIG. 2 is a perspective view of a cabinet similar to FIG. 1 except that the drawers (not shown) are mounted behind a pair of cabinet doors.
Figure 1:
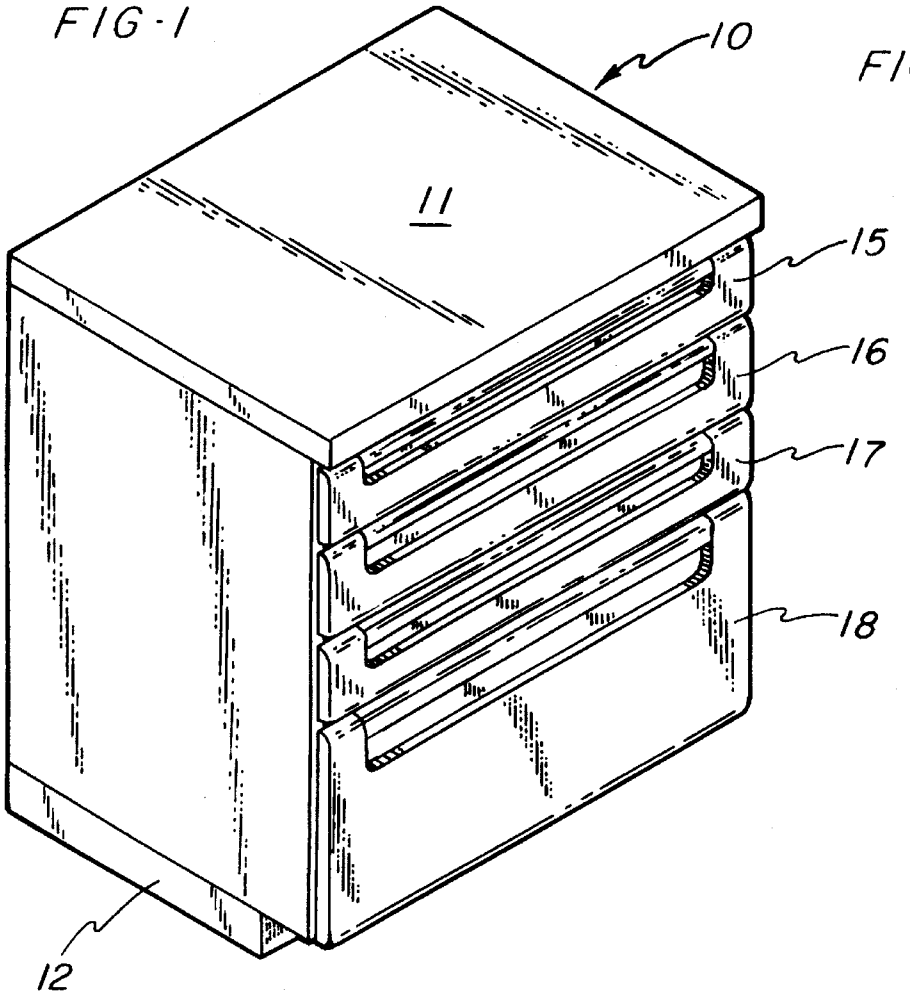
FIG. 1 is a perspective view of a drawer-type cabinet to which this invention may be applied having panel-front drawers.
Figure 12:
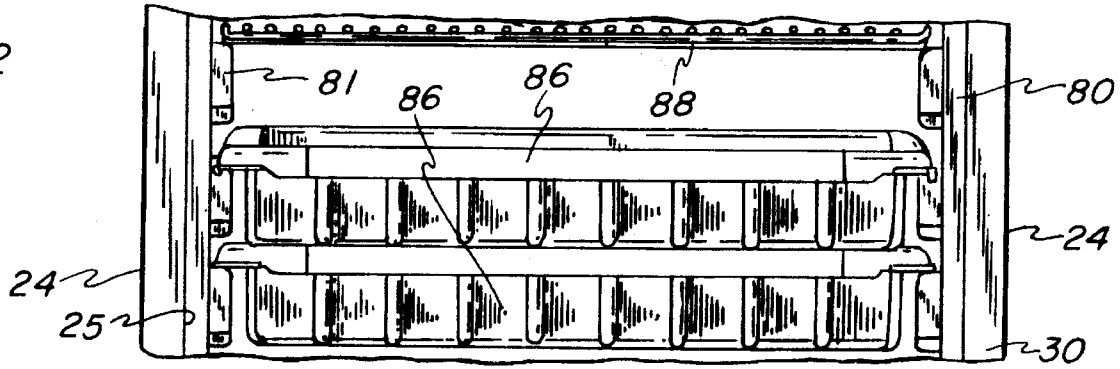
Figure 13:
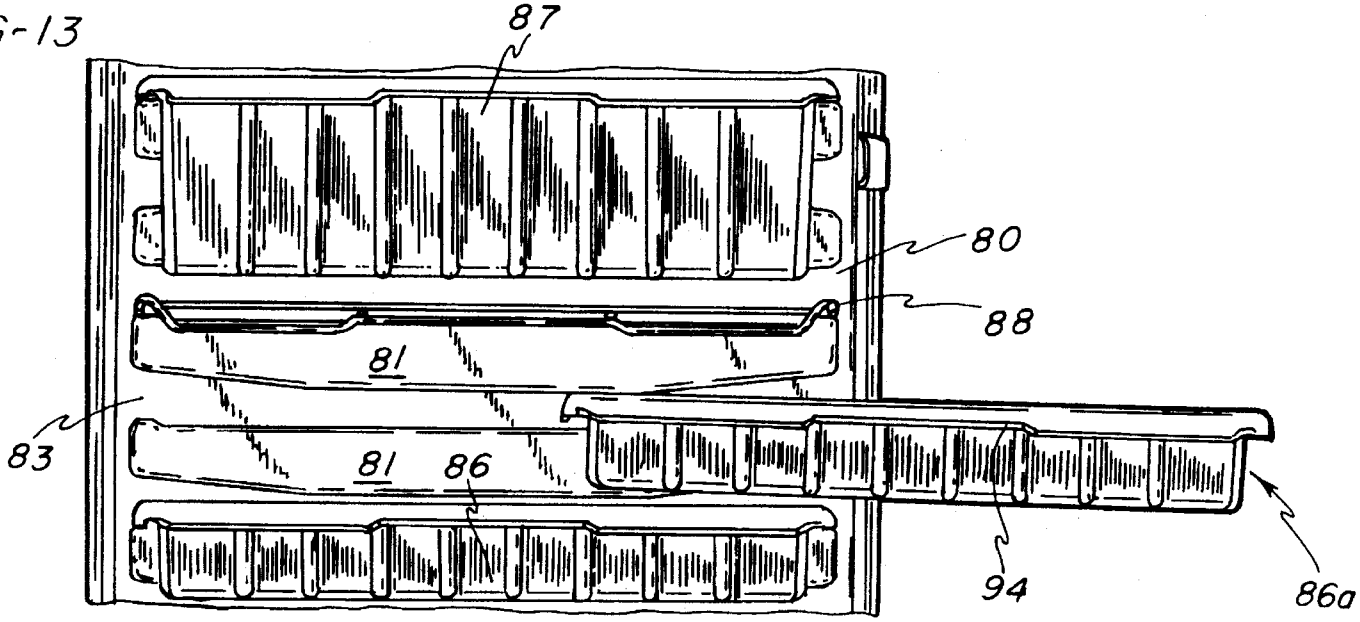

FIG. 12 is a partial front view of a cabinet of either the drawer-type or the door-type as illustrated in FIGS. 1 and 2, showing the cabinet interior following conversion to a slide-type of support and showing typical slide tubs and a wire shelf received therein; and FIG. 13 is a side view showing one of the tubs pulled forwardly of the cabinet, and also showing a wire shelf in place on one of the ledges.

DESCRIPTION OF PREFERRED EMBODIMENT

Referring to the figures of the drawing, which illustrate a preferred embodiment of the invention, a first convertible drawer-type storage cabinet adapted for the use and employment of the concepts of this invention is illustrated generally at 10 in FIG. 1. The cabinet 10 is shown as a free-standing cabinet, although it will be understood that this cabinet may be part of a system of cabinets, in which the cabinet top 11 is actually a continuous counter top which is common to a plurality of individual cabinets.

The cabinet 10 is shown as mounted on a base 12 and as having a plurality of individual panel front drawers 15, 16, 17 and 18 mounted therein, which drawers are accessible from the front of the cabinet.

A typical door-type cabinet is illustrated at 10*a* in FIG. 2. This cabinet differs from the cabinet 10 in that the drawers are not formed with front panels as illustrated by the drawers 15–18 of FIG. 1, but, rather, are formed with pans without fronts (not shown) to provide clearance for the doors 20 and 21 to close across the face of the cabinet.

Figure 3:
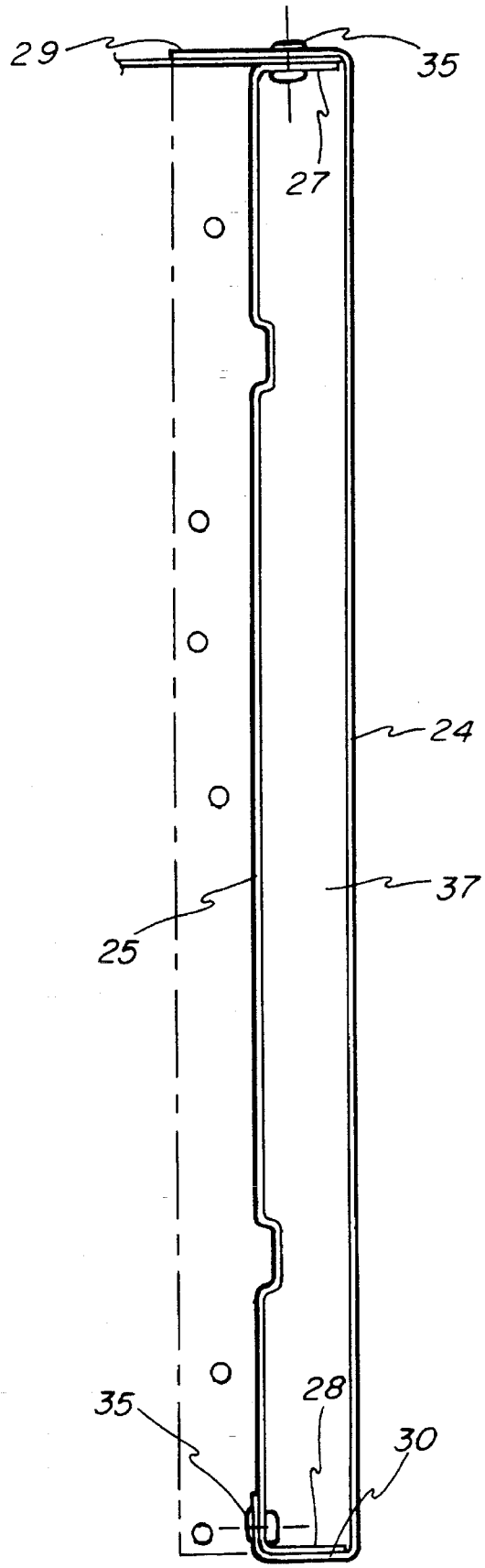
FIG. 3 is a transverse section through one of the side walls of the cabinet of either FIGS. 1 or 2.
Figure 10:
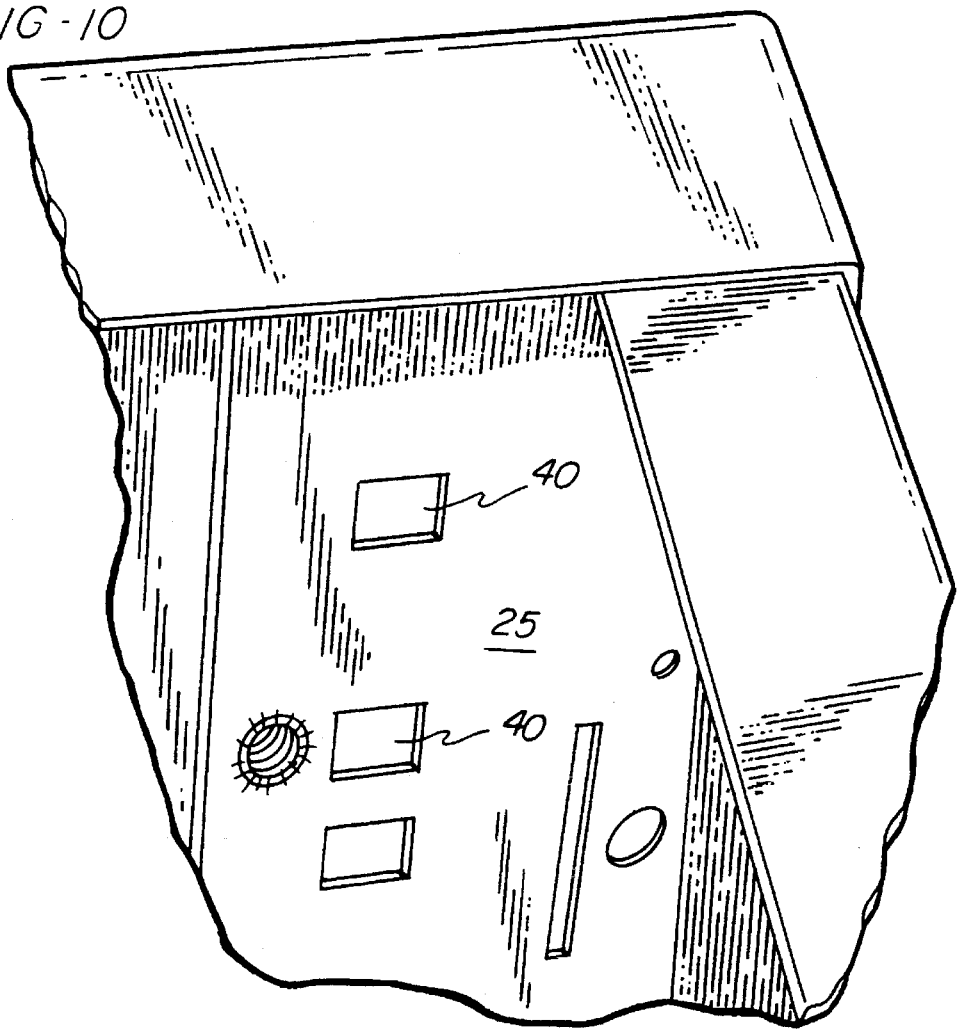
FIG. 10 is a view showing the manner of installing a mounting clip for the liner.

Referring to FIG. 3, which is a sectional view through one of the side walls of the cabinet of FIG. 10 or FIG. 10*a*, it will be seen that the side wall is formed with an outer sheet metal wall member 24, forming the outer side wall of the cabinet and supporting, in spaced relation, an inner wall 25. The inner wall 25 is formed with forwardly or laterally extending terminal flanges 27 and 28 which define the spacing between the walls 24 and 25 and which are received within exterior flanges 29 and 30 of the outer wall 24. The inner and outer walls are joined in assembled relation by means of rivets 35 which join the panels at their respective laterally extending flanges to form a relatively rigid construction, in which the inner and outer walls are spaced, thereby defining an interior space 37.

Figure 4:
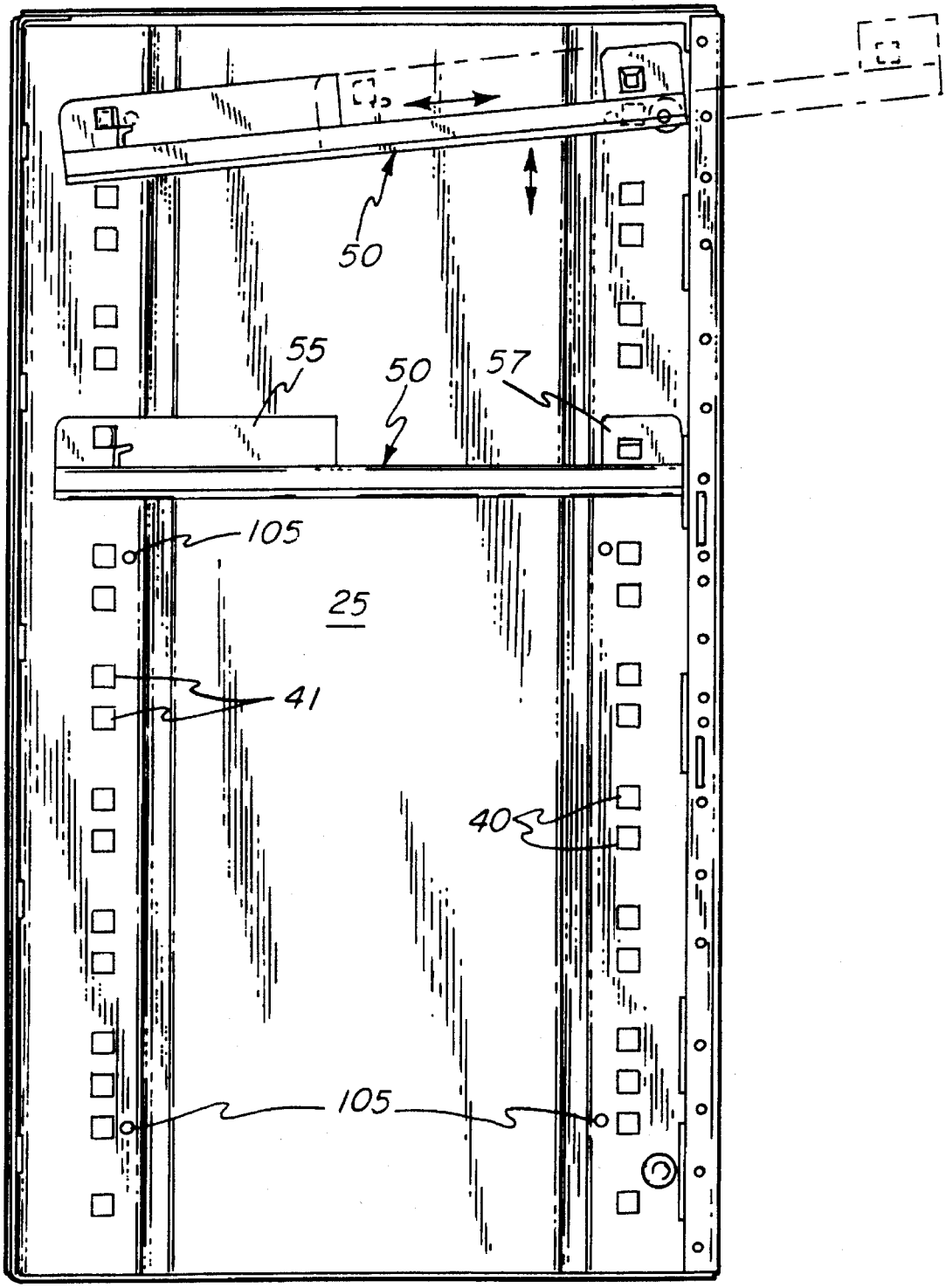
FIG. 4 is a side elevation of the side wall of FIG. 3, viewed from the inside of the cabinet and showing the mounting of a pair of drawer glides.

Referring to FIG. 4, it will be seen that the wall 25 defines two series of vertically spaced openings 40 and 41. A front series of openings 40 extends vertically adjacent a front edge 42 of the wall 25 and a rear series of vertically-spaced openings 41 extend adjacent, but in spaced relation to a rear edge 43.

The openings of each of the series of openings 40 and 41 are horizontally aligned to define front and rear opening pairs for the purpose of receiving the mounting bayonets of a mechanical extension glide 50. It will be understood that the opposite side wall, that is the wall that is positioned in opposed relation to the wall 25 illustrated in FIG. 4, is provided with identical glide-receiving openings, thereby defining a plurality of vertical positions in which pairs of drawer supporting mechanical extension glides 80 may be mounted.

Figure 5:
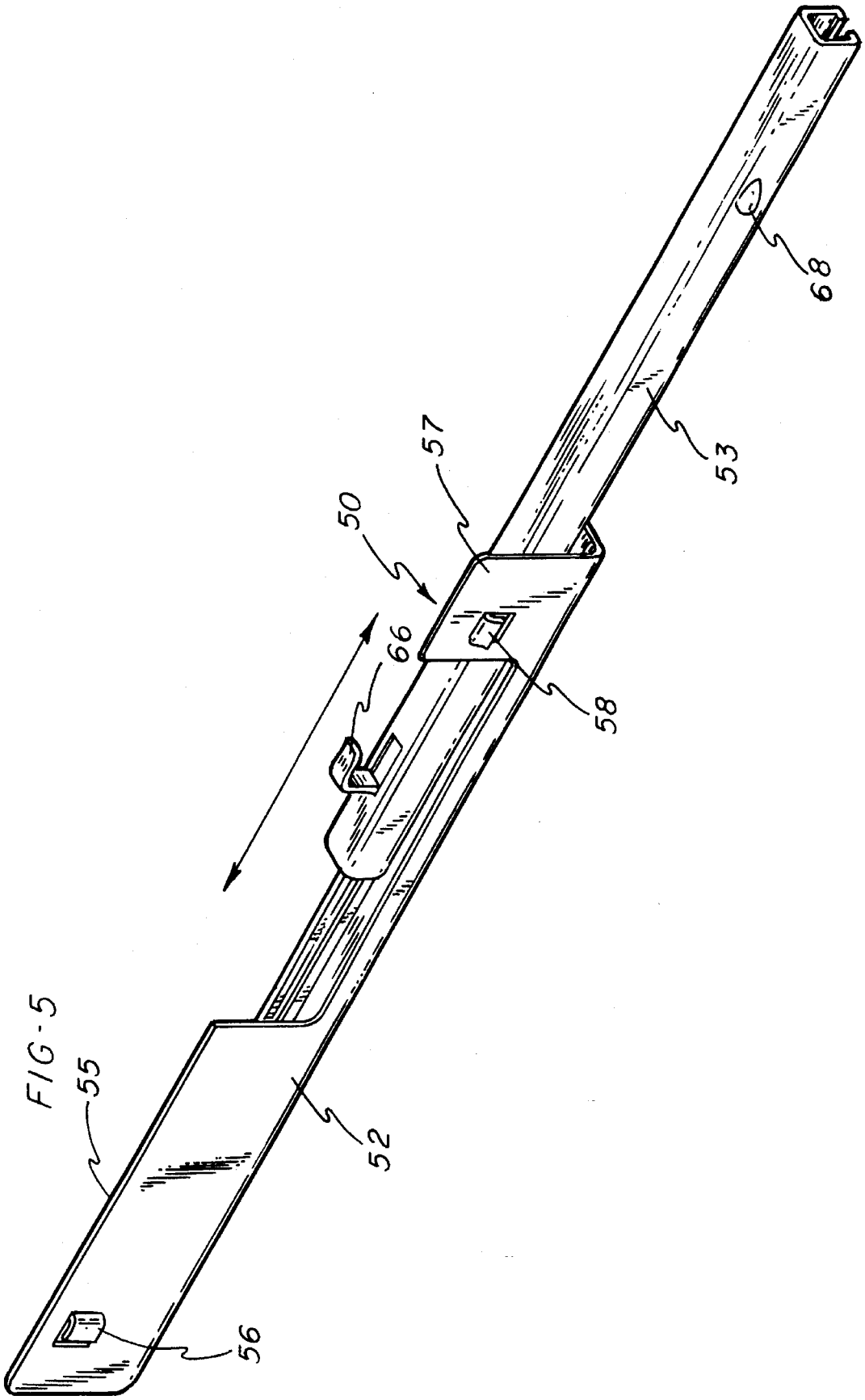
FIG. 5 is a perspective view of one of the glides showing the glide in an extended position.

The extension glides 50, sometimes referred to as extension slides, are mounted, for each of the drawers, on the inside wall 25 and may readily and quickly be demounted and moved to a different vertical position, as shown. A useful glide 50 for this purpose is illustrated in FIG. 5 as including a stationary or non-movable wall mounted part 52 and an extension drawer supported part 53. Preferably, the extension part 53 rolls on roller or ball bearings with respect to the stationary part 52 for ease of movement.

It will be seen in FIG. 5 that the stationary part 52 is formed with a first vertical flange portion 55 formed with a rearwardly extending integral bayonet 56, and a second vertically extending part 57 formed with a downwardly extending bayonet 58. The bayonets 56 and 58 are proportioned to be received within one of the openings 40, 41 and are spaced apart corresponding to the spacing of the aligned pairs of such openings, so that the rearwardly extending bayonet 56 may be inserted in one of the openings 41 while the downwardly extending bayonet 58 may be inserted in the other opening 40 of the pair of openings.

Figure 6:
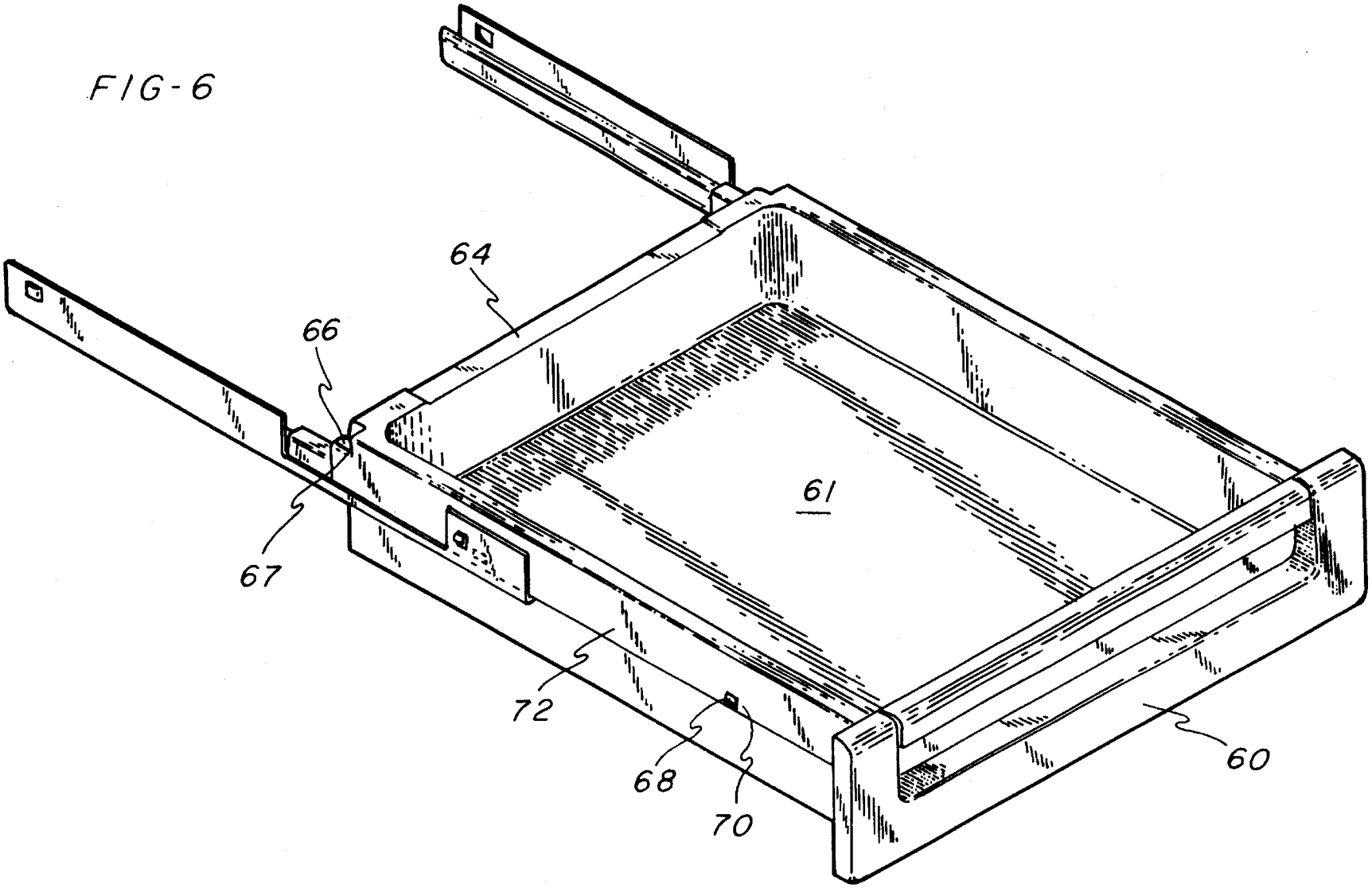
FIG. 6 is a perspective view of one of the drawer pans having a drawer front and mounted on a pair of glides.

A particularly advantageous drawer glide and drawer pan mounting arrangement is that which is more fully and completely described in the copending application of Czarnecky et al entitled "Cabinet Having Drawers with Cover Flanges" filed concurrently herewith and incorporated herein by reference. This copending application describes in greater detail the manner in which the mechanical glides 50 may be reversed in their position, so that the drawer pans themselves may be reversed within the cabinets after the removal of the front panels 60 from the molded plastic drawer pans 61 (FIG. 6). Such reversed drawer pans 61, as mounted on the glides 50, are thus then adapted for use within the door-type cabinet 10*a* of FIG. 2. The drawer pan 61 of FIG. 6, when reversed in relative position on the glides and with the front panels 60 removed, presents an integral handle grip portion 64 to the front thereof.

The pans 61 of the drawer may be molded of plastic material and are removably mounted and carried directly on the extension part 53 by inserting a forwardly extending hook 66 over an integral rear ledge 67 formed on the pan, and inserting a detent 68 into a side aperture 70 formed in an integral downwardly extending longitudinal flange 72 formed along each of the lateral sides of the pan 61.

Figure 7:
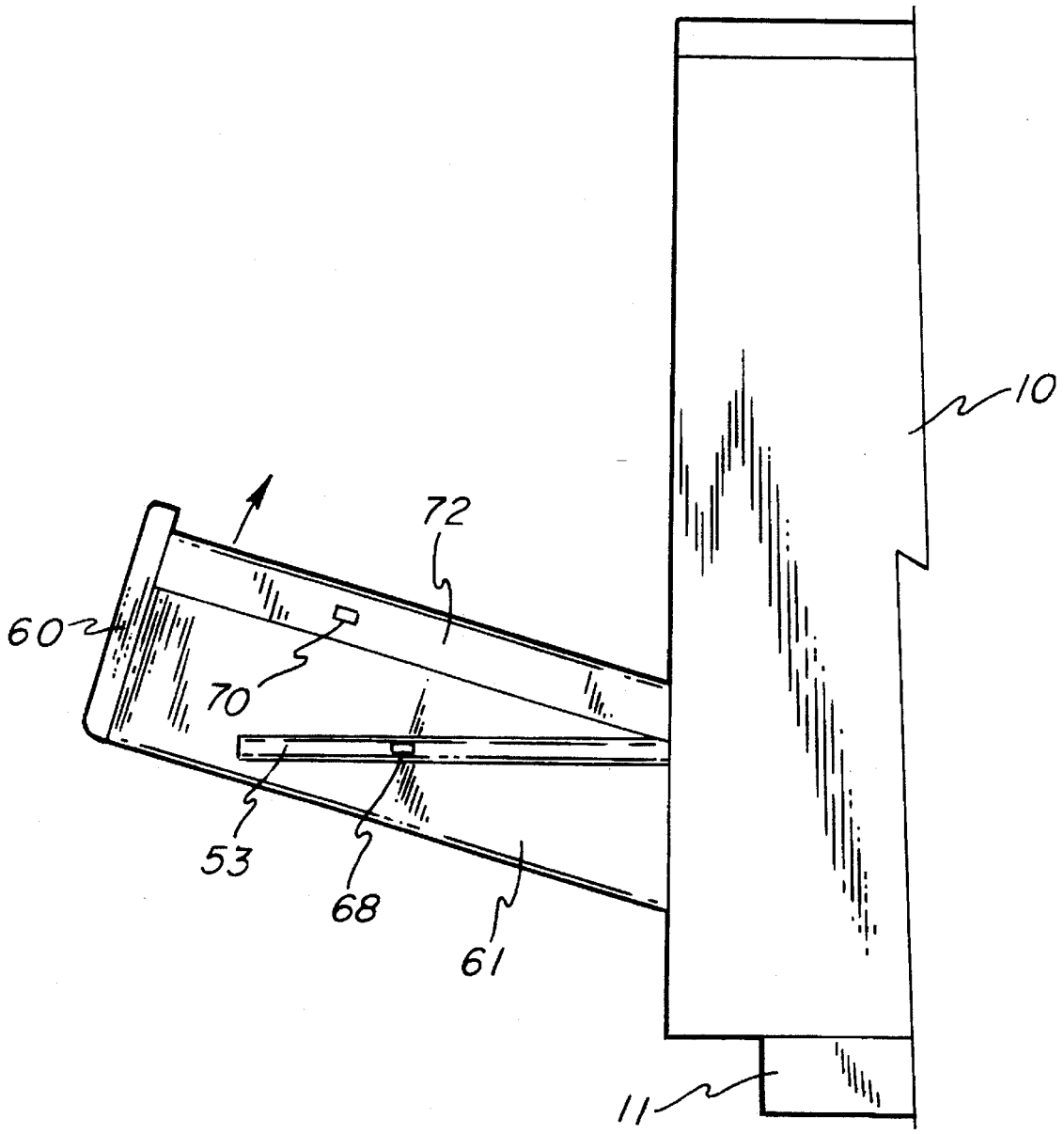
FIG. 7 is a side elevation of the cabinet of FIG. 1, with the cabinet being shown partly broken away, and with one of the drawer pans withdrawn from the cabinet in the act of being disengaged from its associated glide, for removal.

One of the important advantages of the combination more fully and completely described in the above-identified copending application is that the downwardly extending flanges 72 totally enclose the moving glide parts 53 to prevent contamination of the glide mechanism by spilled fluids or the like. A further advantage is that the pan 61 is removable and reversible in position on the glides, as previously noted, simply by manually spreading apart the integral side flanges 72, for the purpose of releasing the detent 68 from the notch 70 and then lifting the pan out of the cabinet to disengage the hook 66 therefrom, in the manner illustrated in FIG. 7. After the drawer pan 61 is removed, the glides 50 may be disengaged from their predetermined mounted position in the wall 25, by lifting the forward end of the slide and then moving the glide forwardly, as illustrated by the position of the glide 50 at the top of FIG. 4.

When all of the drawers and glides are removed, the cabinet 10 or 10*a* may now be readily converted for the purpose of receiving slide trays, bins and/or wire racks of the kind which are commonly used throughout the health care industry, and as particularly used on medical carts. A typical slide system for supporting tubs, trays and the like, is illustrated in Propst et al, U.S. Pat. No. 3,716,282 issued Feb. 13, 1973. A typical cart adapted for slide tubs, shelves and trays is shown in Kelly et al., U.S. Pat. No. 5,011,240, issued Apr. 30, 1991.

Typically and historically, cabinets which have been manufactured for the purpose of supporting, on glides, drawers and the like, have not been convertible to a slide-type of utilization as shown in the Propst et al. and Kelly et al. patents, and conversely, storage cabinets which are formed with molded with specially configured side wall tracks for the purpose of retaining molded plastic pans, trays, and/or wire shelves have not been convertible to drawer-type storage. Therefore, cabinets which have been made for one type of storage usually must be removed from their installed position and replaced in their entirety by cabinets made for the other type of storage when the needs of the facility demand, and this is accomplished only with a substantial economic loss in the pre-existing facilities.

Figure 8:
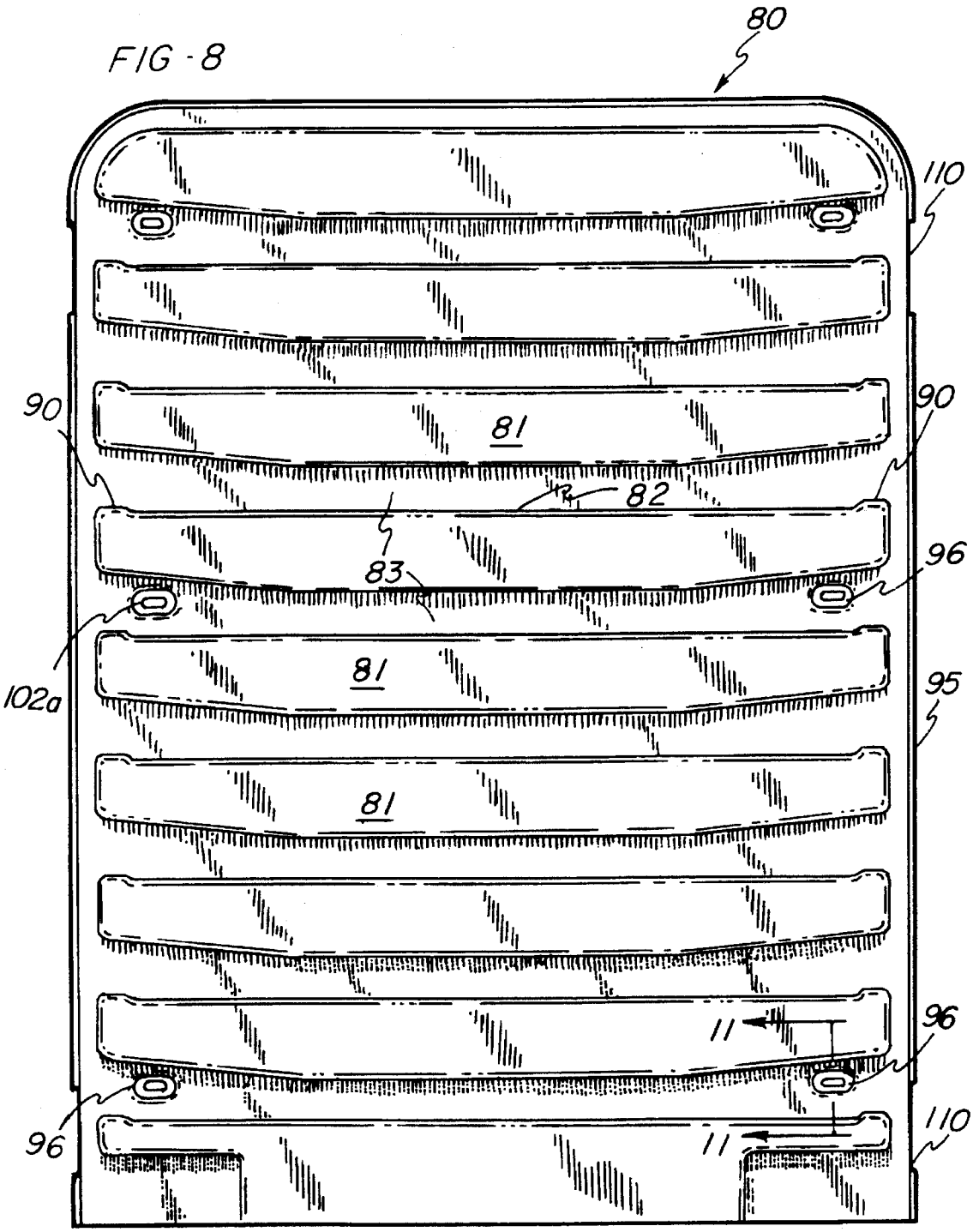
FIG. 8 is an elevational view of a molded plastic side wall liner which fits into and is mounted against one of the inside side walls of the cabinet in converting the cabinet to a slide arrangement.
Figure 9:
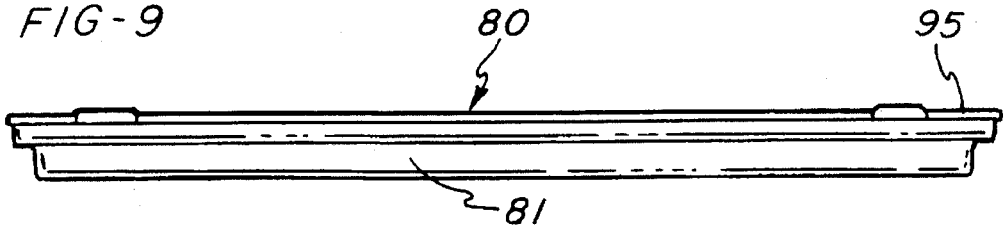
FIG. 9 is a top view of the liner of FIG. 8.

For the purpose of this invention, molded plastic side wall panels or liners are employed as illustrated in 80 in FIGS. 8 and 9. A pair of such panels 80 of identical construction and configuration may be used as the left-hand liner and the right-hand liner, and they are configured to be received within and mount directly against the inside walls 25 of the cabinet 10 or 10*a*.

The glide track panels 80 may be advantageously vacuumed formed for the purpose of forming raised portions 81 which define individual shelf support surfaces 82 and track ways 83 therebetween. The raised portions 81 and the track ways 83 are vertically spaced from each other for the purpose of accommodating individual storage tubs such as the tubs 86 and 87 as illustrated in FIGS. 12 and 13 or for the purpose of accommodating a wire shelf 88. The forward and rearward ends of the back surfaces 82 are slightly raised or elevated as shown at 90 for the purpose of providing a stop which cooperates with a recess portion 94 of the side wall of the tub, as shown for example with the tub 86*a* which has been extended through the front of the cabinet in FIG. 13.

Figure 11:
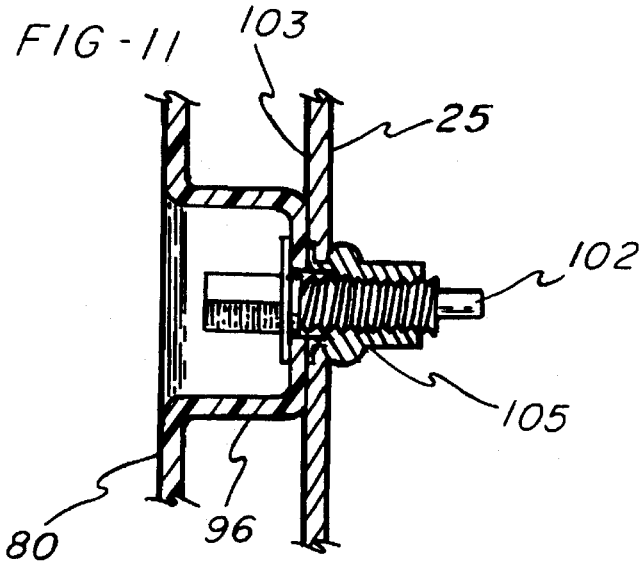
FIG. 11 is a fragmentary sectional view through the side wall with the plastic liner installed taken generally along the line 11—11 of FIG. 8.

The molded plastic side wall liners 80 are formed with a peripheral locating ledges which may be positioned against the margins of one of the inner side walls 25 of the cabinet or along at least the front and rear marginal edges of the side wall. The liners 80 are further formed with bosses 96 which are in vertical alignment and adjacent to one of the sets of openings 40, 41 formed in the side wall 25. When a liner 80 is positioned against the side wall, each boss becomes positioned adjacent one of the openings 40 or 41 and is attached to the side wall, preferably by means of an internally threaded rivet fastener 100, as illustrated in FIGS. 10 and 11. The internally threaded rivet fasteners may be of the kind sold under the trademark "Rivnut" of Rivnut Engineered Products, Inc., or internally threaded rivet fasteners as marketed by Perlane Sales, Inc., 1943 East Aurora Road, Twinsburg, Ohio 44087. Such fasteners are easily and readily inserted into blind openings, such as the holes 105 (FIG. 4) positioned inwardly and adjacent to selected ones of the openings 40 or 41, by hand tools or machine tools are well known in the art for the purpose of installing such internally threaded rivet fasteners.

The fastener 100 may be installed in selected openings or holes 105 adjacent the openings 40 or 41, and forms the means by which the liner 80 may be attached at one of the bosses 96 by means of a hex-headed screw 102, as shown in the fragmentary sectional view of FIG. 11. The fastener 102 is received in the boss 96 through a slot 102*a* (FIG. 8).

The slots 102*a* may be transversely elongated for the purpose of permitting a precise positioning of the liner 88 within the cabinet, as necessary, to assure that doors, if any, may be fully closed and to assure, in the case of the cabinet 10, that the edges of the liner do not protrude beyond the cabinet side walls.

In the conversion of the cabinet to the slide-type of storage, in which a plurality of stationary shelf support ledges slidably support baskets, tubs and the like, it is only necessary to remove the pre-existing drawers from the mechanical glides 50, as previously described and to remove the glides themselves, thereby leaving the interior walls or surfaces 25 unobstructed. Individual internally-threaded rivet fasteners 100 are then installed at the appropriate positions within each of the side walls 25, and the liners 80 are brought into position and secured on the mounted rivet fasteners by the screw 102.

In the case of a panel drawer type of cabinet, the front of the cabinet will now be open substantially as illustrated in FIG. 12 and will contain a plurality of tubs, if desired, as illustrated by the tubs 86. However, in the event that the cabinet has closure doors 20, 21, suitable cut-outs 110 (FIG. 8), may be provided in the marginal edge 95 of the liners 80 for the purpose of receiving the door hinges and thereafter the doors may be closed with the liners and tubs installed. A particular advantage of the invention resides in the fact that the basic cabinetry, when desired, may be easily and readily reconverted for drawer use simply by reversing the procedure which has been described.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A convertible drawer-type storage cabinet in which mechanical extension glides support a plurality of drawers, comprising:

a cabinet case having at least two spaced-apart side walls, a top and a bottom, each of said side walls being formed with an outer side wall, and an inner side wall mounted in spaced relation to an associated said outer side wall, means in each of said inner side walls defining openings positioned adjacent a front edge and a rear edge of each side wall and providing means by which pairs of drawer supporting extension glides may be removably mounted on said inner side walls within the cabinet for supporting drawers thereon, a pair of side wall liners, one for each of said inner side walls, a plurality of stationary shelf-support ledges formed in said liners said ledges being relatively vertically spaced to each other and defining slide surfaces for receiving of slid type storage devices, and each of said liners having a plurality of attachment bosses each in general alignment with one of said inner side wall opening, said liner may be secured by a fastener to an associated said side wall when said glides are removed from said cabinet.

2. A convertible drawer-type storage cabinet in which mechanical extension glides support a plurality of drawers, comprising:

a cabinet case having at least two spaced-apart side walls, a top and a bottom, each of said side walls being formed with an outer side wall, and an inner side wall mounted in spaced relation to an associated said outer side wall, means in each of said inner side walls for supporting pairs of drawer supporting extension glides which are removably mounted within the cabinet for supporting drawers, a plurality of internally threaded fasteners in each of said side walls for receiving a retaining screw, a pair of molded plastic side wall liners, one for each of said inner side walls, said liners being formed with a locating peripheral flange positionable against the margins of one of said inner side walls along at least said front and rear edge, a plurality of shelf-support ledges formed in said liners inwardly of said peripheral flange, said ledges being relatively vertically spaced to each other and defining therebetween slide spaces for receiving the support surfaces of slid type storage devices, and each of said liners having a plurality of attachment bosses each in general alignment with one of said threaded fasteners in an inner side wall for securing said liner to an associated said side wall by retaining screws in certain ones of said fasteners when said glides are removed from said cabinet.

3. A drawer-type cabinet which is convertible from an arrangement in which extension glides support a plurality of drawers to an arrangement in which slide-type storage devices, such as wire shelves, wire baskets and molded plastic tubs, are slidably mounted on stationary guideways, comprising:

a cabinet case having at least two spaced-apart side walls, a top and a bottom, means on each of said side walls defining two vertical rows of individual vertically spaced openings extending respectively adjacent a front edge and a rear edge of each side wall and providing means by which pairs of extension glides may be removably mounted on said inner side walls for supporting drawers, a pair of molded plastic side wall liners, one for each of said side walls, a plurality of stationary shelf-supporting slide ledges formed in said liners, said ledges being relatively vertically spaced in relation to each other and defining therebetween a slide space for receiving a sliding surface of said slide-type storage devices, each of said liners having a plurality of discrete attachment bosses each formed in general adjacent alignment with one of said openings, and securing means to secure said liners at said bosses to said side walls, thereby converting said cabinet to receive slide-type storage devices.

* * * * *